United States Patent [19]

Revels

[11] Patent Number: 4,793,552

[45] Date of Patent: Dec. 27, 1988

[54] MAILBOX SERVICE INDICATOR

[76] Inventor: Jewel W. Revels, Rte. 2, Box 448, Rockwood, Tenn. 37854

[21] Appl. No.: 157,251

[22] Filed: Feb. 18, 1988

[51] Int. Cl.[4] ..... B65D 91/00

[52] U.S. Cl. ..... 232/35; 232/34

[58] Field of Search ..... 232/34, 35, 17

[56] References Cited

U.S. PATENT DOCUMENTS

| | | | |
|---|---|---|---|
| 670,553 | 3/1901 | Brown . | |
| 743,297 | 11/1903 | Lawrence . | |
| 745,749 | 12/1903 | Wheeler . | |
| 768,100 | 8/1904 | Walsh . | |
| 965,426 | 7/1910 | Welch . | |
| 1,021,026 | 3/1912 | Welch . | |
| 1,292,050 | 1/1919 | Raney . | |
| 1,685,874 | 10/1928 | Feist . | |
| 2,352,975 | 7/1944 | Roe | 232/35 |
| 2,356,020 | 8/1944 | Westerfield | 232/35 |
| 2,592,555 | 4/1952 | Gensmer | 232/35 |
| 2,807,410 | 9/1957 | Ward | 232/35 |
| 2,834,539 | 5/1958 | Carey | 232/35 |
| 3,291,386 | 12/1966 | Van Fleet | 232/35 |
| 3,498,255 | 3/1970 | Haeberle | 232/35 |
| 3,523,639 | 8/1970 | Wiebe | 232/35 |
| 3,606,141 | 9/1971 | Taylor | 232/35 |
| 3,960,317 | 6/1976 | Clement | 232/35 |
| 4,018,379 | 4/1977 | Carter | 232/35 |
| 4,147,292 | 4/1979 | Fisher | 232/35 |
| 4,390,122 | 6/1983 | Saoko | 232/35 |

*Primary Examiner*—Robert W. Gibson, Jr.
*Attorney, Agent, or Firm*—Pitts and Brittian

[57] ABSTRACT

A signalling device for attachment to a mailbox to visually indicate service to the mailbox. This signalling device is installed without any alterations to the mailbox by fastening its mounting plate to the top friction latch member with a pair of encircling straps. There is a transverse cylindrical body member at the front end of the mounting plate, with a pivot member extending through the body member. The pivot member is substantially parallel with the front of the mailbox and thus with the door. A signal flag member is pivoted on the pivot member such that it can be moved from a "tripped" position against the mounting plate to an upright "set" position. The signal flag member has a pair of leg members that substantially touch the mailbox door when the signal flag member is "set"; the door moving against these legs to trip the signal flag member when the door is opened. Various friction-engaging embodiments are disclosed to reduce the chance of false "trip" due to wind, rain, vibration, etc.

18 Claims, 2 Drawing Sheets

MAILBOX SERVICE INDICATOR

1. Technical Field

This invention relates generally to signal devices for visually indicating the delivery of mail to mail boxes, and more particularly to a mailbox service indicator for attachment, without any modification, to mail boxes of the type having cooperating friction catch members on the door and on the top of the box.

2. Background Art

Many mailboxes, particularly in rural areas, are situated a substantial distance from persons who wish to know of mail (or newspaper) delivery. In inclement weather, especially, an indicator of such delivery would be of considerable help.

Numerous devices have been described in the prior art for the purpose of providing an indicator of mail delivery. Most of these devices require either a substantial modification of the existing mailbox, or at least the attachment of signal components with permanent fasteners, such as bolts, requiring the use of drills and other tools.

One prior art signalling device that requires a minimum restructuring of a mailbox is that shown and described in U.S. Pat. No. 4,147,292, issued to B. Fisher on Apr. 3, 1979. The device of this patent has a mounting plate that is fastened to the top of a mailbox of the type having cooperating friction catch members. The friction catch member on the body of the box is fastened by bolts or rivets. According to Fisher, notches in the mounting plate receive those bolts (or bolts substituted for rivets after their removal), and the retightening of the bolts secures the mounting plate to the top of the mailbox. The mounting plate has an up-turned side member, and a signal flag is pivotally mounted from this side member. The signal flag includes, in one embodiment, a downwardly extending leg to interact with the door whereby opening of the door forces the leg outward causing the signal flag to be dropped. A second embodiment, the only claimed embodiment, depends upon friction between the flag and a separately-mounted clip on the door whereby gravity causes the flag to drop when the door is opened. Even with the simplified construction of Fisher, tools are required for installing the mailbox, and the structure of the box is changed by the drilling of holes (to remove rivets or to install door clip). Thus, there is a deterrent to the moving of the signalling flag to another box.

Accordingly, it is an object of the present invention to provide a signal indicator that visually displays service to a mailbox, the device being attachable to a friction catch type mailbox without any alteration to the box.

It is another object of the present invention to provide a mailbox service indicator that can be easily installed or removed from a mailbox having conventional cooperating friction catch members.

A further object of the present invention is to provide a visible mailbox service indicator that is easily installed and provides resistance to being moved from a "set" position by wind or other factors, but has substantially no desistance when tripped so as to easily fall to the "delivered" position.

These and other objects of the present invention will become more apparent upon a consideration of the drawings that follow, when taking together with a complete description thereof.

DISCLOSURE OF THE INVENTION

In accordance with the present invention, there is a mounting plate for attachment to the top surface of the box-mounted friction clasp of a typical rural mailbox. This mounting plate is attached by a pair of non-extensible, preferably plastic, straps. A forward end of the mounting plate carries a substantially cylindrical body oriented so as to have an axis substantially parallel with the ground and substantially perpendicular with a front-to-back direction in the box. This cylindrical body is provided with a passageway along its axis. A signal flag is pivotally mounted at both ends of the cylindrical body with a pivot pin passing through the passageway whereby the signal flag can be raised from a substantially horizontal "tripped" position to a substantially vertical "set" position. The signal flag has a leg extending at each edge which engages the mailbox door in the "set" position whereby opening of the door drops the signal flag to the "tripped" position. Frictional contact between moving components is provided at or near the "set" position to provide resistance to false tripping due to rain, wind, vibration, etc.

BEST MODE FOR CARRYING OUT THE INVENTION

Figure 1:
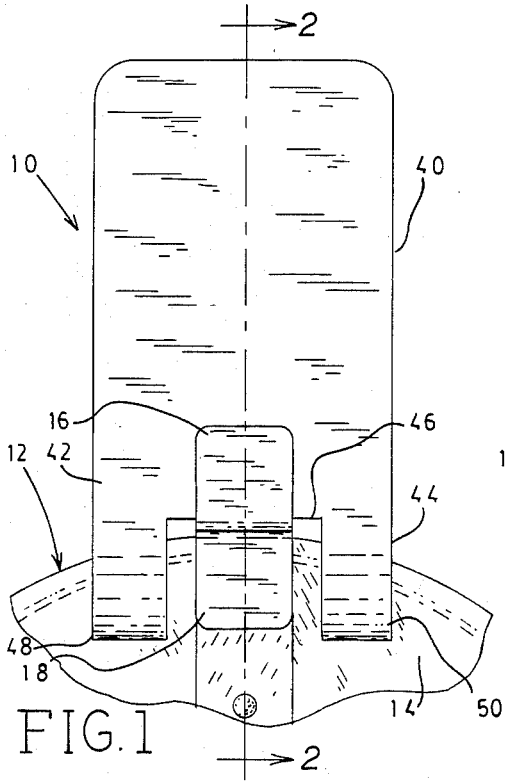
FIG. 1 front view of a delivery signal device for a mailbox having cooperating friction catch members, with the signal flag in an upright or "set" position.
Figure 2:
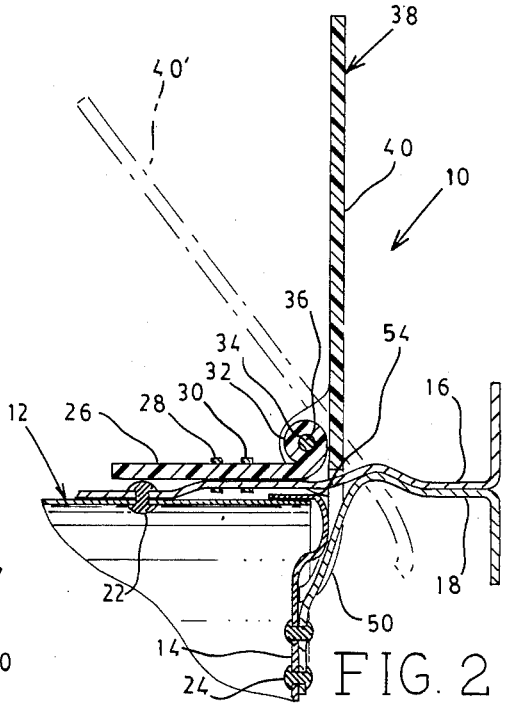
FIG. 2 is a cross-sectional view of the invention, as taken at 2—2 in FIG. 1, also illustrating (in phantom lines) the signal flag intermediate the "set" and "tripped" positions, together with one embodiment of a friction-producing structure to minimize false signalling.
Figure 3:
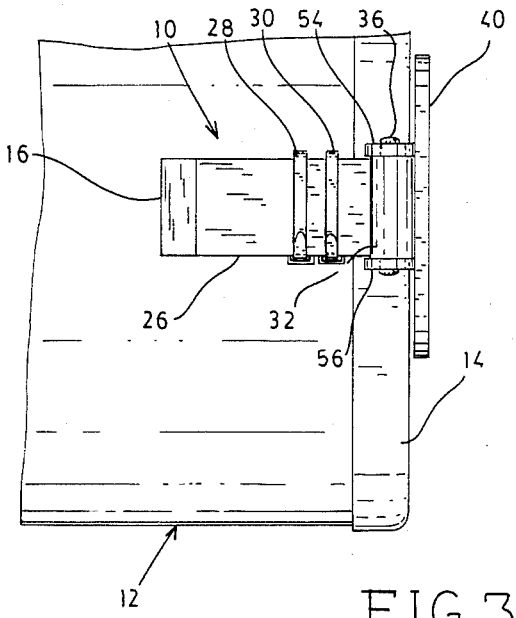
FIG. 3 is a top view of the invention illustrated in FIG. 1.

Referring now to FIGS. 1–3, shown generally at 10 therein is one embodiment of a mailbox service signalling device. This device 10 is specifically constructed for use with a mailbox 12 having a front-opening door 14 and cooperating friction latch members 16, 18. The latch member 16 is mounted upon the top 20 of the mailbox with at least one rivet 22 or like fastener. This latch member 16 has a forward portion spaced a small distance above the top 20 toward the door 14, as shown. The second latch member 18 is fastened to the door 14 as with at least one rivet 24. The construction of the box, door and latch members is that found in essentially all 37 rural"-type mailboxes.

The device 10 has a mounting plate 26 that is adapted to be attached to the top of the latch member 16 with non-extensible straps 28, 30 which closely encircle both the latch member 16 and the mounting plate. These straps pass through the region where the latch is spaced above the top of the box. Although not shown, the corners of the mounting plate under the straps can be notched to prevent movement of the straps along the mounting plate. A typical strap is of the type often used for closely tying electrical cables into bundles, such as that illustrated in FIG. 4.

The forward end (toward the door 14) of the mounting plate 26 carries, in a preferred embodiment, a generally cylindrical body 32. This body 32 has an axis across the mounting plate, and a passageway or bore 34 is provided along this axis. As discussed below, a pivot pin 36 passes through the bore 34. In a prefered embodiment, the plate 26 and cylindrical body 32 are integrally formed; however, they can be separate parts which are subsequently joined by any suitable means. Of course, the body 32 can have a configuration other than cylindrical.

The device 10 further has a signal flag portion 38. This includes a flag member 40 with a pair of legs 42, 44 that are positioned in front of the box 12. A cut-out 46 between the legs permits their extension on either side of the latch members 16, 18. In the preferred form of this invention, the extreme ends 46, 50, respectively, of the legs are curved as shown so a to substantially contact the door 14 when the signal member 40 is in an upright "set" position. This feature is preferred since the rim of the door 14 normaly projects outward from the remaining portion of the door. Thus, any outward movement of the door 14 will immediately pivot the flag member 40 so as to permit gravity to move the flag member to a "tripped" or "signal" position. Shown in phantom lines (at 40') in FIG. 2 is the flag member as partially fallen to the "tripped" position.

The rear surface of the flag member is provided with a pair of bracket or journal members 52, 54 such that one journal member is positioned adjacent each end of the cylindrical body 32. These journal members 52, 54 are each provided with apertures (not shown) to permit the passage of the pivot pin 36 therethrough. These journal members can be integrally formed with the flag member 40, or can be attached thereto by any suitable means such as glue, braze (if metal), rivets, etc.

In this embodiment, at least one of the journal members (e.g. 54) has a peripheral contour such that when the flag member is in a "set" (upright) position, there is frictional engagement between the journal member 54 and the door 14 at a position such as identified at 58. This frictional engagement resists any pivoting of the flag member 40 due to wind, heavy rain, vibration, etc. Thus, the flag member 40 is only tipped to the "tripped" position when the door 14 is intentionally opened to apply force to the ends 48, 50 of the legs 42, 44.

Figure 4:
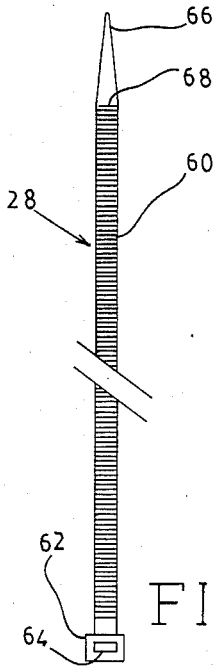
FIG. 4 is a plan view of a typical strap as utilized for the securing of the present invention to a conventional mailbox.

Shown in FIG. 4 is an example of the type of strap 28 which can be used to fasten the mounting plate 26 to the latch member 16. This particular strap 28 is a commercially available plastic strap, as will be known by persons in the electrical art, useful for tying multiple wires to form a "harness" of wires. It has an elongated and non-extensible body 60, one end of which carries a head 62 provided with an opening 64. The other end 66 is generally pointed, as shown, to facilitate threading through the opening 64. The body is provided with transverse notches 68. The interior of the opening 64 has a surface that cooperates with the notches such that once the body has been looped around an object, and end 66 threaded through the opening 64, the body cannot be easily withdrawn from the opening. When used with the present invention, as illustrated in FIGS. 2 and 3, this type strap will maintain the mounting plate 26 tightly against the latch member 16 without any alteration of the mailbox in any way.

The operation of this embodiment of FIGS. 1–3 will be apparent upon a study of these drawings. When it is desired to determine when mail has been delivered (or removed) from the box 12, a user elevates the flag member 40 to the upright "set" position. In this position, the curved ends 48, 50 of the legs contact the front of the mailbox door 14. Also, the frictional contact between journal 54 and/or journal 56 against the rim of the door at 58 prevents inadvertent tripping of the signal. When the latch members 16, 18 are disengaged by the opening of the door, the flag member 40 is tipped rearwardly whereupon it falls to a "tripped" position against the top of the box 12. This is an indication to the user that the door has been opened; thus, eliminating needless trips to the mailbox.

Figure 5:
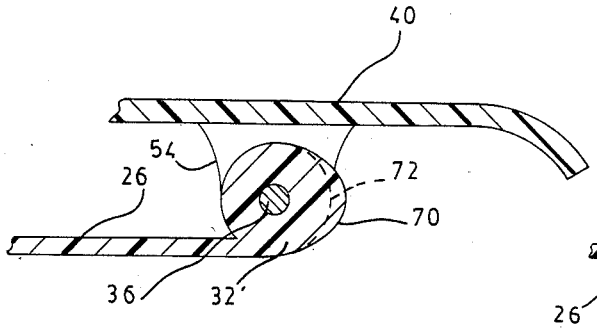
FIG. 5 is a partial cross section illustrating another embodiment of a friction-producing structure.
Figure 6:
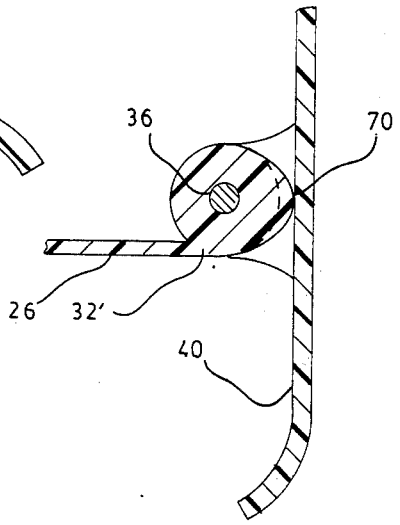
FIG. 6 is a partial cross section of the embodiment of FIG. 5 with the signal flag in the "set" position.

Although one embodiment of "frictional engagement" is shown (FIG. 2) and described, other very useful constructions of the present invention can be used to provide resistance to accidental tripping of the signal member. One such alternate embodiment is illustrated in the cross-sections of FIGS. 5 and 6. These figures show the components slightly enlarged so as to better illustrate their construction. In this embodiment, the cylindrical body 32' is modified by providing a cam surface 70 that extends from the normal cylindrical surface 72. With this construction, the height of the cam surface 70 is selected so as to frictionally engage the rear surface of the flag member 40, as shown in FIG. 6, when the flag member is in the "set" position. When the flag member is slightly rotated, this cam surface 70 no longer contacts the rear surface and, thus, the flag member 40 is free to fall to its "tripped" position.

Figure 7:
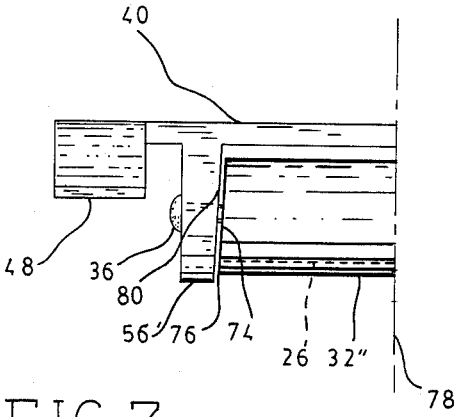
FIG. 7 is a partial drawing illustrating still another embodiment of a friction-producing structure for the present invention, without a box, as viewed from in front of a box with the signal flag in a "tripped" position.
Figure 8:
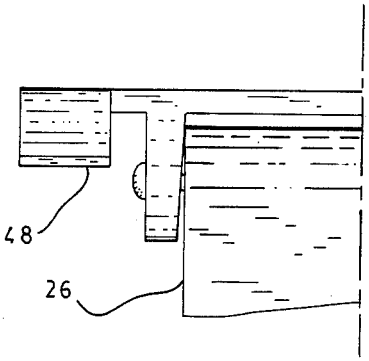
FIG. 8 is a partial drawing of the embodiment of FIG. 7 with the signal flag rotated to the upright, "set" position as viewed from below.

Still another and preferred embodiment of means for providing frictional engagement when the flag member 40 is in its elevated "set" position is illustrated in FIGS. 7 and 8. In FIG. 7, for example, at least one end 74 of the cylindrical body 32" is sloped with respect to a perpendicular to the axis of the pivot pin 36. This provides a position on the end 74, as at 76, that is more removed from centerline 78. The inner surface 80 of the cooperating journal member 56' is sloped a corresponding amount so that through some rotation of the journal member 56' with respect to the body 32", there is little or no contact. However, when the flag member 40 is moved to be at right angles to the mounting plate 26 (FIG. 8), this moves the position 76 into frictional engagement with the surface 80. While only one end of the cylindrical body 32" can be shaped as shown, it will be understood that the opposite end (or both ends) can be similarly configured to provide frictional engagement.

Other than the form of structure to provide frictional engagement when the flag member is fully elevated, the operations of the embodiments of FIGS. 5–6 and 7–8 are identical to that described relative to FIGS. 1–3.

From the foregoing, it will be understood by those versed in the art that a very simple yet effective signalling device has been provided to visually indicate service to a mailbox. All of the components thereof can be formed from durable plastic or metal. The preferable material is a moldable plastic such that the two main segments can be integrally formed: the mounting plate 26 and cylindrical body 32; and the flag member 40, with legs 42, 44, and the journal members 54, 56. The pivot pin can also be plastic or metal, in the form of a bolt and nut or as a rivet. Through the use of commercially available straps, the signal device is easily attached to a mailbox having the upper latch member slightly spaced above the top of the mailbox. For those boxes where there is no spacing, the upper latch member can be manually lifted to permit insertion of the straps thereunder. Of course, other types of straps can be utilized.

Although only limited constructions of the present invention are described herein, this is not intended to limit the invention. Rather, the invention is only to be limited by the appended claims or their equivalents when read together with the detailed description.

I claim:

1. A service signalling device for mailboxes of the type having cooperating friction latch members, at least one latch member being attached to a top of the mailbox body, said latch member having a substantially flat exposed surface, said mailbox provided with an access door, said service signalling device comprising:

a mounting plate member for placement juxtaposed said flat exposed surface of said latch member, sad mounting plate having a first end directed toward said door, and a second end;

a cylindrical body member joined to said first end of said mounting plate, said body member having an axis transverse said mounting plate and substantially parallel to a plane of said door, said body member provided with an axial bore;

a pivot member extending through said bore;

a signal flag member having a forward surface and a rearward surface, said signal flag defining a perimeter and provided with a cutout portion in said perimeter to define a pair of leg members having terminal ends;

a pair of journal members carried by said rearward surface of said signal flag member, said journal members positioned whereby said legs extend past opposite edges of said latch member, said journal members provided with aligned apertures to receive said pivot member whereby said signal flag member can be pivoted from a "tripped" position substantially parallel with said mounting plate to a "set+ position substantially parallel to said door; and friction engagement means adapted to provide friction when said signal flag member is in said "set" position to inhibit pivoting motion of said signal flag member away from said "set" position unless said door is opened away from said mailbox body.

2. The service signalling device of claim 1 wherein said signal flag member is substantially planar, and said perimeter substantially defines a rectangular with a pair of long edges and a pair of short edges, and wherein said cutout is in one of said short edges.

3. The service signalling device of claim 2 wherein said terminal ends of said legs are contoured so as to substantially touch said door when said signal flag member is in said "set" position.

4. The service signalling device of claim 1 wherein:

said mounting plate member and said cylindrical body member are integrally formed; and said signal flag member and said journal members are integrally formed.

5. The service signalling device of claim 2 wherein:

said mounting plate member and said cylindrical body member are integrally formed; and said signal flag member and said journal members are integrally formed.

6. The service signalling device of claim 1 wherein said friction engagement means comprises:

a sloped surface on at least one end of said cylindrical body member to provide a point on said sloped surface more removed from a midpoint between ends of said cylindrical body member; and a cooperating sloped surface on at least one of said journal members oriented toward said sloped surface of said cylindrical body member;

said sloped end surface on said cylindrical body member and said sloped surface on said journal oriented to produce friction therebetween only when said signal flag member is in said "set" position.

7. The service signalling device of claim 1 wherein said friction engagement means comprises a cam surface on at least one of said journal members, said journal members, said cam surface oriented to frictionally engage a rim of said door when said signal flag member is in said "set" position.

8. The service signalling device of claim 1 wherein said friction engagement means comprises a cam surface on said cylindrical body, said cam surface oriented to frictionally engage said rearward surface of said signal flag member when said signal flag member is in said "set" position.

9. The service signalling device of claim 1 further comprising a pair of spaced apart strap members encircling said juxtaposed mounting plate and said latch member at a position between said first and second ends of said mounting plate for immobilizing said mounting plate when said signal flag member is pivotally moved around said pivot member.

10. A service signalling device for mailboxes of the type having a hollow body with an access door and cooperating friction latch members, at least one latch member attached to a top of said mailbox body, said latch member having a substantially flat exposed surface, said service signalling device comprising:

a substantially rectangular mounting plate juxtaposed against said flat exposed surface of said latch member, said mounting plate having a width substantially equal to a width of said latch member and a length greater than said width, said mounting plate having a first end toward said door, and a second end;

a pair of spaced-apart strap members encircling said juxtaposed mounting plate and said latch member at selected positions between said first and second ends of said mounting plate;

a substantially cylindrical body member joined to said first end of said mounting plate, said body member having an axis transverse to a long dimension of said mounting plate and substantially parallel to a plane of said door, said body member provided with an axial bore;

a pivot member extending through said bore;

a substantially rectangular and planar signal flag member having a forward surface and a rearward surface, said signal flag member having a long dimension substantially perpendicular to said pivot member thereby defining a top and bottom edge of a lesser dimension than side edges, said signal flag member provided with a cutout portion in said bottom edge to define a pair of leg members having terminal ends, each of said leg members disposed on opposite sides of said latch member;

a pair of journal members carried by said rearward surface of said signal flag member, said journal members positioned to be adjacent ends of said body member and each provided with aligned apertures to receive said pivot pin whereby said signal flag member can be pivoted from a "tripped" position substantially parallel with said mounting plate to a "set" position substantially parallel with said door; and friction engagement means adapted to provide friction when said signal flag member is in said "set" position to inhibit pivotal movement of said signal flag member unless said door is opened away from said mailbox body.

11. The service signalling device of claim 10 wherein said terminal ends of said legs are contoured so as to substantially touch said door when said signal flag member is in said "set" position.

12. The service signalling device of claim 10 wherein:

said mounting plate member and said cylindrical body member are integrally formed; and said signal flag member and said journal members are integrally formed.

13. The service signalling device of claim 10 wherein said friction engagement means comprises:

a sloped surface on at least one end of said cylindrical body member to provide a point on said sloped surface more removed from a midpoint between ends of said cylindrical body member; and a cooperating sloped surface on at least one of said journal members oriented toward said sloped surface of said cylindrical body member;

said sloped end surface on said cylindrical body member and said sloped surface on said journal oriented to produce friction therebetween only when said signal flag member is in said "set" position.

14. The service signalling device of claim 10 wherein said friction engagement means comprises a cam surface on at least one of said journal members, said journal members, said cam surface oriented to frictionally engage a rim of said door when said signal flag member is in said "set" position.

15. The service signalling device of claim 10 wherein said friction engagement means comprises a cam surface on said cylindrical body, said cam surface oriented to frictionally engage said rearward surface of said signal flag member when said signal flag member is in said "set" position.

16. The services signalling device of claim 10 wherein each of said strap members comprises:

an elongated body member having flat surfaces and a first end and a further end, said body member being provided with transverse grooves in at least one of said flat surfaces;

a head member integrally formed with said body member at said first end, said head member provided with an aperture therethrough, said aperture sized to closely receive said body member as threaded through said aperture; and engagement means within said aperture adapted for interacting with said grooves to prevent removal of said body member from said aperture.

17. A service signalling device for mailboxes of the type having a hollow body with an access door and cooperating friction latch members, at least one latch member attached to a top of said mailbox body, said latch member having a substantially flat exposed surface, said mailbox provided with an access door, said service signalling device comprising:

a substantially rectangular mounting plate juxtaposed against said flat exposed surface of said latch member, said mounting plate having a width substantially equal to a width of said latch member and a length greater than said width, said mounting plate having a first end toward said door, and a second end;

a pair of spaced-apart strap members encircling said juxtaposed mounting plate and said latch member at selected positions between said first and second ends of said mounting plate;

a substantially cylindrical body member joined to said first end of said mounting plate, said body member having an axis transverse to a long dimension of said mounting plate and substantially parallel to a plane of said door, said body member provided with an axial bore;

a pivot member extending through said bore;

a substantially rectangular and planar signal flag member having a forward surface and a rearward surface, said signal flag member having a long dimension substantially perpendicular to said pivot member thereby defining a top and bottom edge of a lesser dimension than side edges, said signal flag member provided with a cutout portion in said bottom edge to define a pair of leg members having terminal ends, each of said leg members disposed on opposite sides of said latch member;

a pair of journal members carried by said rearward surface of said signal flag member, said journal members positioned to be adjacent ends of said body member and each provided with aligned apertures to receive said pivot pin whereby said signal flag member can be pivoted from a "tripped" position substantially parallel with said mounting plate to a "set" position substantially parallel with said door; and friction engagement means adapted to provide friction when said signal flag member is in said "set" position to inhibit pivotal movement of said signal flag member unless said door is opened away from said mailbox body said friction engagement means including a sloped surface on at least one end of said cylindrical body member to provide a point on said sloped surface more removed from a midpoint between ends of said cylindrical body member, and a cooperating sloped surface on at least one of said journal members oriented toward said sloped surface of said body member, said cooperating sloped surfaces oriented with respect to each other to produce friction between said more removed point and said slope of said journal member only when said signal flag member is in said "set" position.

18. The services signalling device of claim 17 wherein each of said strap members comprises:

an elongated body member having flat surfaces and a first end and a further end, said body member being provided with transverse grooves in at least one of said flat surfaces;

a head member integrally formed with said body member at said first end, said head member provided with an aperture therethrough, said aperture sized to closely receive said body member as threaded through said aperture; and engagement means within said aperture adapted for interacting with said grooves to prevent removal of said body member from said aperture.

* * * * *